US005152117A

United States Patent [19]

Wynar

[11] Patent Number: 5,152,117

[45] Date of Patent: Oct. 6, 1992

[54] CORNER CONSTRUCTION AND WALLBOARD BACKER BRACKET THEREFOR

[76] Inventor: Roger N. Wynar, 6 Eagle Heights Dr., Orchard Park, N.Y. 14127-3901

[21] Appl. No.: 660,040

[22] Filed: Feb. 25, 1991

[51] Int. Cl.[5] ..... E04C 5/00

[52] U.S. Cl. ..... 52/712; 52/241; 52/221

[58] Field of Search ..... 52/238.1, 241, 281, 52/285, 489, 712, 715

[56] References Cited

U.S. PATENT DOCUMENTS

| | | | |
|---|---|---|---|
| 683,119 | 4/1964 | Carlton . | |
| 2,236,258 | 8/1939 | Burson | 20/4 |
| 2,285,167 | 5/1942 | Burson | 52/241 |
| 3,210,898 | 10/1965 | Kurtz | 52/281 |
| 3,308,590 | 3/1967 | Ettore et al. | 52/285 X |
| 3,862,535 | 1/1975 | Byssing | 52/712 X |
| 3,881,293 | 5/1975 | Conville | 52/712 |
| 4,313,688 | 2/1982 | Daniels | 52/712 X |
| 4,329,820 | 5/1982 | Wendt | 52/241 |
| 4,366,660 | 1/1983 | Pearson | 52/741 |
| 4,467,579 | 8/1984 | Weinar | 52/281 |
| 4,932,173 | 6/1990 | Commins | 52/712 X |
| 4,965,980 | 10/1990 | Leavens | 52/712 |
| 4,991,373 | 2/1991 | Shaub | 52/715 |

*Primary Examiner*—Richard E. Chilcot, Jr.
*Assistant Examiner*—Creighton Smith

[57] ABSTRACT

An inside corner bracket prevents the separation of intersecting wallboard panels without nailing the panels or the brackets to the framing members at the corner joint.

5 Claims, 2 Drawing Sheets

CORNER CONSTRUCTION AND WALLBOARD BACKER BRACKET THEREFOR

This invention relates to gypsum wallboard installation. It is particularly directed to a metal backer bracket for use in place of some of the wood framing members normally used at wall and ceiling corners.

In normal wood frame construction, inside corners formed by intersecting walls and ceilings pose a problem for the installation of the wallboard panels. Abutting corner panels require back up framing to prevent deflection and separation during joint taping and finishing. For example, a vertical corner construction at an interior partition wall often includes an extra wallboard backer stud on each side of the wall. Perimeter walls also require additional lumber to be attached to the top plates to provide backing for the ceiling panels. The installation of this backer lumber is very costly, both in labor and material, and backer lumber will often twist, bow or otherwise distort causing finished joint failure along intersecting wallboard panels. The presence of the additional backing lumber also temps the wallboard installers to nail both panels to the framing at the intersecting corners. Industry specifications instruct installers to omit fasteners close to intersecting corners to the plastered gypsum panel joints are not influenced by the normal movement of the framing. Several backer have been introduced to the industry, some with considerable success. All of the known clips eliminate the need for back blocking lumber but all have to be nailed or otherwise mechanically fastened to the framing lumber. This procedure is costly, and labor intensive. Perhaps as important, fastened clips necessarily move with the lumber moves, causing joint cracks that are difficult if not impossible to permanently repair.

It is an object of this invention to provide a wallboard corner bracket that will prevent the separation of intersecting wallboard panels without being nailed or otherwise fastened to the framing members.

Another object of the invention is to provide a wallboard backer bracket that may be configured to inside corners that are greater or less than ninety degree right angles.

Still another object of the invention is to provide a backer bracket with a distortable end portion that will orientate and strengthen the wallboard panel and framing intersection.

These and other objects and advantages of this invention will hereinafter be readily apparent when considered in relation to the preferred embodiments as set forth in the specification and shown in the drawings which:

Figure 8:
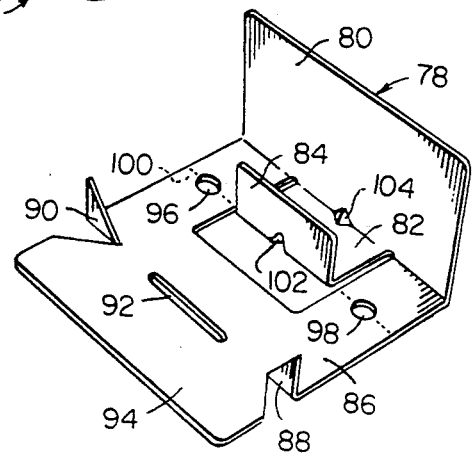

FIG .7 is a cross-sectional view of a typical cathedral ceiling construction requiring deformed backer brackets like those illustrated in the previous two views; and FIG. 8 is a perspective view of a modified configuration of a wallboard backer bracket embodying the features of this invention.

Figure 1:
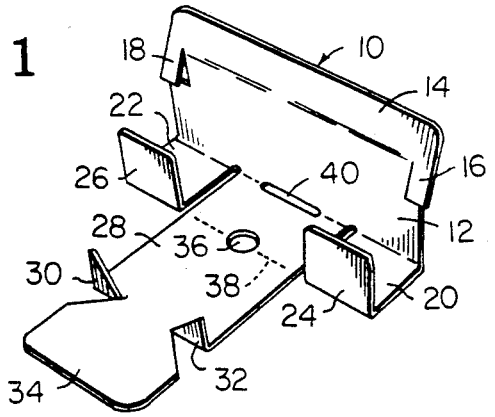
FIG. 1 is a perspective view of a preferred configuration of a wallboard backer bracket embodying the features of this invention.
Figure 3:
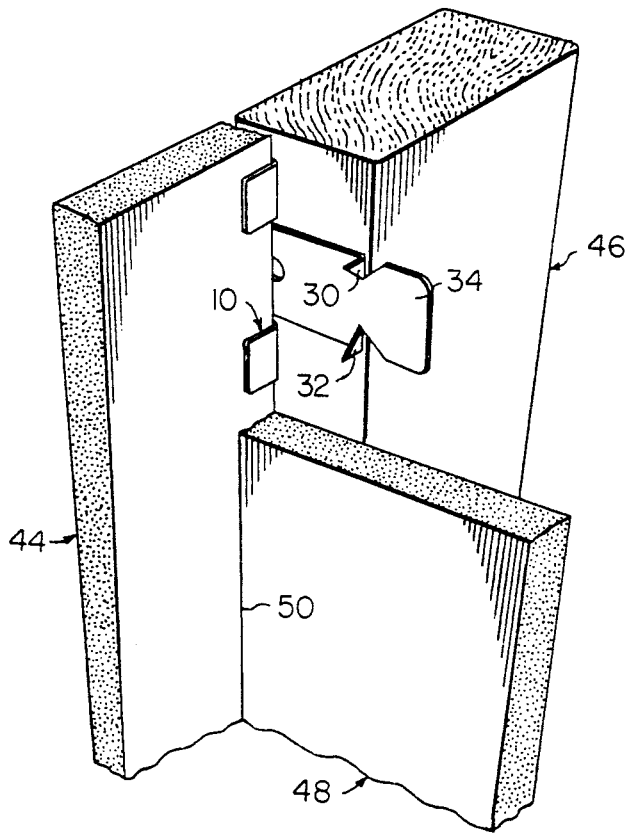
FIG. 3 is a fragmented pictorial view of a typical corner construction showing intersecting wallboard panels, and one installed backer bracket.
Figure 2:
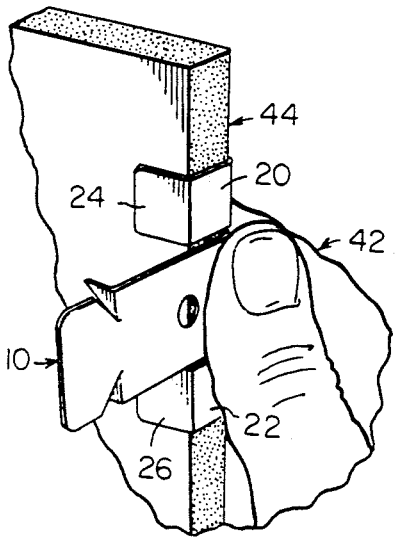
FIG. 2 is a fragmented pictorial view showing the bracket being installed on a typical wallboard panel.
Figure 4:
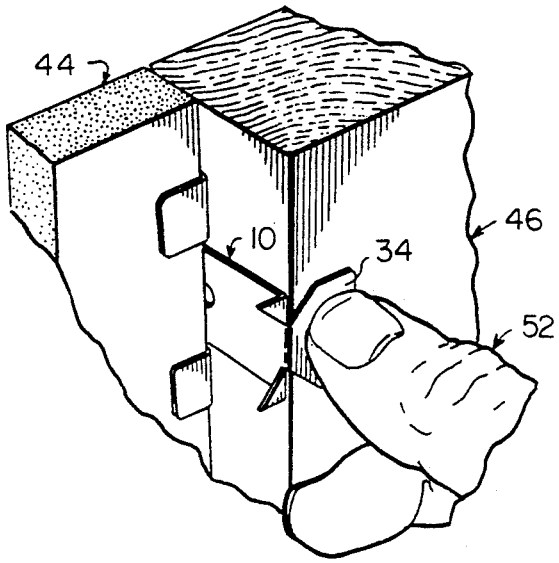
FIG. 4 is a fragmented pictorial view of a typical corner construction showing a backer bracket portion bent around a framing member.
Figure 5:
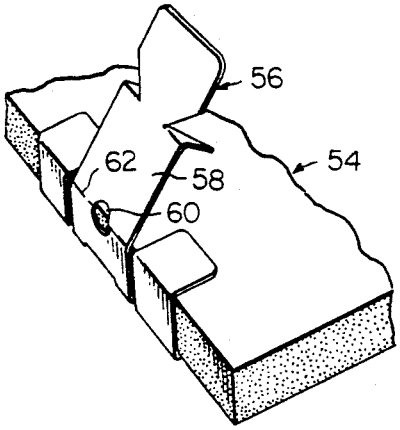
FIG. 5 is a pictorial view of a wallboard fragment showing a backer bracket of this invention that has been distorted to conform to an inside corner of less than ninety degrees.
Figure 6:
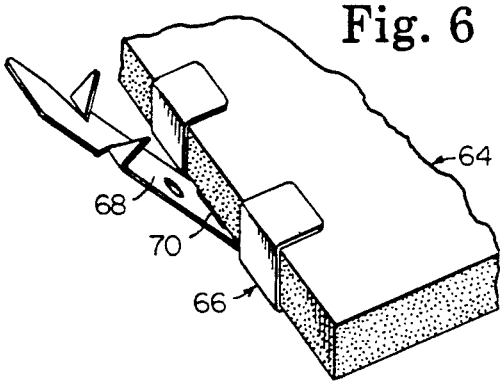
FIG. 6 is a pictorial view of a wallboard fragment showing a backer bracket of this invention that has been deformed to conform to an inside corner greater than ninety degrees.
Figure 7:
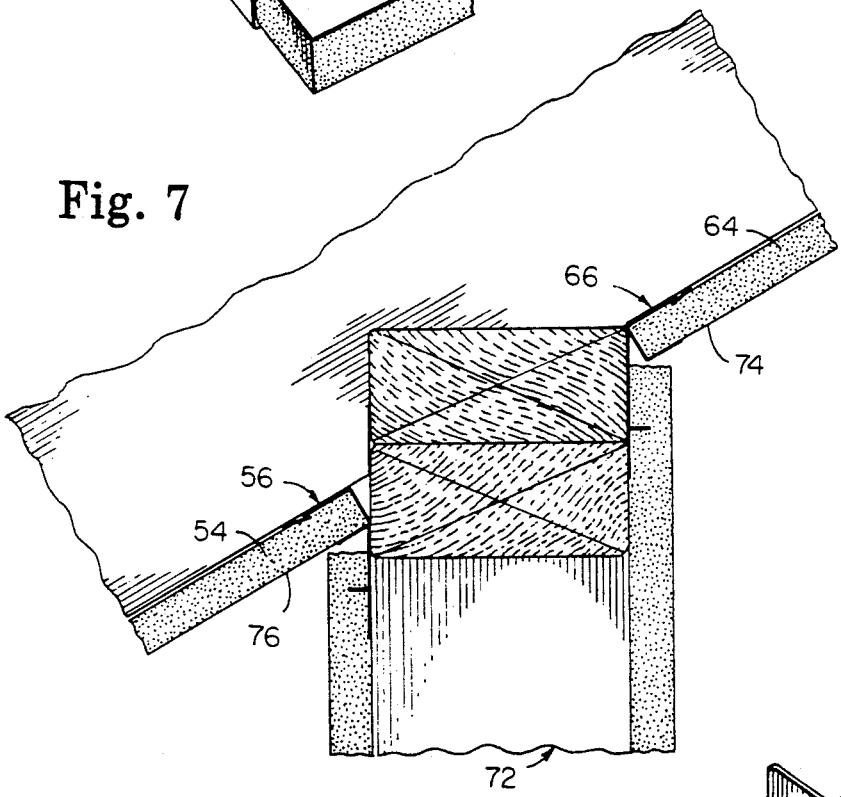

Referring to FIG. 1, backer bracket 10 of the invention, formed from a single sheet metal or plastic material, is comprised of a first wallboard back surface contacting flange portion 12, including a deflected lead-in terminal edge segment 14 and wallboard indenting segments 16 and 18, web portions 20 and 22 extending at approximate right angles from said flange portion 12 a distance approximate the wallboard panel thickness, wallboard front surface contacting second flange portions 24 and 26 extending substantially parallel to said first flange portion, a second wallboard panel contacting tongue portion 28, including protruding segments 30 and 32 useful for penetrating the second wallboard, struck from said tongue portion, thus reducing the material width of said tongue portion to form bendable terminal tab segment 34. Hole 36 is centered between second flange portions 24 and 26 to weaken and encourage tongue portion 28 to bend inward along tangent line 38, hole 40 is provided to weaken and encourage tongue portion 28 to bend outward along the joinder line of first flange portion 12. Referring to FIG. 2, installer uses hand 42 pressure to install typical bracket 10 on a first wallboard panel 44. The wallboard is held between the first flange portion 12 (hidden) and flange portions 24 and 26. Web portions 20 and 22 extend a distance approximate the wallboard thickness so wallboard indenting portions 16 and 18 (hidden) grip the panel and obstruct accidental removal. In FIG. 3, first wallboard panel 44 with attached bracket 10 has been urged into a vertical position against typical stud framing member 46. A second wallboard panel 48 (Lowered to expose the bracket) abuts first wallboard panel 44 to form inside wallboard corner 50. In actual practice second panel 48 would extend to the top of stud 46 with bracket 10 impaled through the back surface and into the core of said second panel by protruding segments 30 and 32, preventing movement of first wallboard panel 44. A bracket particularly suitable for use with normal drywall panels includes broad pointed protruding segments that easily pierce the back paper surface and penetrate the gypsum core. The broad surfaces of the protruding segments offer considerable resistance to lateral movement so a second stud behind wallboard panel 44 is not required when backer brackets are used. By rotating FIG. 3 ninety degrees clockwise, a typical ceiling corner is illustrated where framing member 46 now represents a typical wall or partition top plate. A recommended practice for gypsum wallboard installation discourages corner nailing to allow the joint to "float" independent of corner framing movement. Joint 50 would typically be finished with several applications of wet gypsum compound over an embedded paper or plastic tape. In FIG. 4 the bracket 10 installer uses thumb 52 pressure to bend tab segment 34 around the corner of stud framing member 46. This procedure is useful to align a bowed or distorted framing member and to prevent outward deflection of wallboard panel 44. Only one or two of the brackets deployed along any joint would need be bent to align a corner. It should be noted that even with the bent tab considerable framing movement can be tolerated without joint cracking. In FIG. 5 wallboard panel segment 54 has an installed bracket 56 with the tongue portion 58 purposefully bent along wallboard panel 54 front edge line 62 with the encouragement of weakening hole 60. The deformed bracket 56 and wallboard panel 54 may be seen installed on the down slope 76 of typical cathedral ceiling construction 72 shown in FIG. 7. In FIG. 6 bracket 66 has the tongue portion 68 purposefully bent along wallboard panel 64 back edge line with the encouragement of weakening slot 70. The deformed bracket 66 and wallboard panel 64 may also be seen installed on the up slope 74 of typical cathedral ceiling construction 72 of FIG. 7. In FIG. 8 a modified backer bracket 78 is comprised of a first wallboard back surface contacting flange portion 80, a web portion 82 extending at approximate right angles from said flange portion 80 a distance approximate the wallboard panel thickness, wallboard front surface contacting second flange portion 84 extending substantially parallel to said first flange portion, a second wallboard panel contacting, "U" shaped tongue portion 86, including protruding segments 88 and 90 useful for penetrating a second wallboard, struck from said tongue portion, reducing the material width of said tongue portion 86 with the help of slot 92 to form bendable terminal tab segment 94. Slot 92 could be replaced with an additional protruding segment struck from the same location or a useful bracket could be configured with a single protruding segment. Holes 96 and 98 centered along second flange portion 84 to encourage tongue portion 86 to bend inward along tangent line 100. Gussets 102 and 104 provide rigidity and increase the panel gripping power of the bracket. A useful bracket could also be configured with a single web portion extending the full width of the first flange portion, and a shortened tongue portion. This configuration would give the tongue portion additional rigidity, but sacrifice the brackets' ability to conform to up slope corners.

Various other modifications may suggest themselves to those skilled in the art without departing from the spirit of my invention and hence, I do not wish to be restricted to the specific form shown or uses mentioned, except to the extent indicated in the appended claims.

What is claimed is:

1. A backer bracket, useful for preventing the separation of intersecting wallboard panels at inside corner constructions, formed from a single sheet of strip material, comprised of a first flange portion, web portion or portions extending perpendicularly from a tongue portion, a second flange portion or portions extending from said web portion substantially parallel to said first flange portion, said tongue portion extending perpendicularly beyond said second flange portion or portions substantially parallel to said web portion or portions, said tongue portion including a substantially perpendicular, protruding segment or segments struck from said tongue portion in the same direction and substantially parallel to said first and second flange portions.

2. An inside corner wall construction including a pair of perpendicularly abutting first and second wallboard panels, a backer bracket, formed from a single sheet of strip material, useful for preventing the joint separation of said panels, said backer bracket comprised of a first flange portion positioned along the back surface of said first wallboard panel, a web portion or portions extending perpendicularly from a tongue portion positioned along the edge surface of said first wallboard panel, a second flange portion or portions extending from said web portion substantially parallel to said first flange portion positioned between the front surface of said first wallboard panel and the edge surface of said second wallboard panel, said tongue portion extending perpendicularly beyond said second flange portion or portions substantially parallel to said web portion or portions positioned along the back surface of said second wallboard panel, said tongue portion including a substantially perpendicular protruding segment or segments struck from said tongue portion in a direction substantially parallel to said first and second flange portions positioned within the core of said second wallboard panel.

3. A backer bracket, useful for preventing the separation of intersecting wallboard panels at right angle inside corner constructions and also corners of greater or less than ninety degree angles, formed from a single sheet of strip material, comprised of a first flange portion, a web portion or portions extending perpendicularly from said first plate portion, a second flange portion or portions extending from said web portion substantially parallel to said first flange portion, a tongue portion extending from said first flange portion perpendicularly beyond said second flange portion or portions substantially parallel to said web portion or portions.

4. A backer bracket according to claim 3 wherein tongue portion weakening holes or apertures are introduced approximate said second flange portion or portions to encourage said tongue portion to bend along a line parallel to said second flange portion and conform to down slope corner of less than ninety degrees.

5. A backer bracket according to claim 3 wherein tongue portion weakening holes or apertures are introduced approximate the joinder line of said tongue portion and said first flange portion to encourage said tongue portion to bend along a line parallel to said first flange portion and conform to up slop corners of greater than ninety degrees.

* * * * *